US008006406B2

(12) United States Patent
Dingee, IV

(10) Patent No.: US 8,006,406 B2
(45) Date of Patent: Aug. 30, 2011

(54) DRYING SYSTEM

(75) Inventor: H. Clay Dingee, IV, Anthem, AZ (US)

(73) Assignee: ISCD Holding, L.P.

( * ) Notice: Subject to any disclaimer, the term of this patent is extended or adjusted under 35 U.S.C. 154(b) by 663 days.

(21) Appl. No.: 11/888,522

(22) Filed: Aug. 1, 2007

(65) Prior Publication Data

US 2008/0028633 A1 Feb. 7, 2008

Related U.S. Application Data

(60) Provisional application No. 60/834,595, filed on Aug. 1, 2006.

(51) Int. Cl.
*F66B 11/03* (2006.01)

(52) U.S. Cl. ..... 34/371; 34/406; 34/413; 34/497; 422/160; 422/50; 427/213; 110/234; 110/252; 137/527.6; 119/211; 119/204; 705/14

(58) Field of Classification Search ..... 34/371, 34/406, 413, 497; 705/14; 110/234, 252; 427/213; 422/160; 137/527.6; 119/211, 119/204

See application file for complete search history.

(56) References Cited

U.S. PATENT DOCUMENTS

| | | | | |
|---|---|---|---|---|
| 2,014,764 A | | 9/1935 | Gram | |
| 2,046,816 A | * | 7/1936 | Fowler, Jr. et al. | 422/160 |
| 2,561,392 A | * | 7/1951 | Marshall | 427/213 |
| 2,643,107 A | * | 6/1953 | Kamm et al. | 432/223 |
| 2,939,579 A | * | 6/1960 | Harlowe | 209/714 |
| 3,256,614 A | | 6/1966 | Dunbar | |
| 3,777,676 A | * | 12/1973 | Lagen | 110/227 |
| 3,794,251 A | * | 2/1974 | Williams | 241/65 |
| 3,862,608 A | * | 1/1975 | Lagen | 110/252 |
| 4,186,772 A | * | 2/1980 | Handleman | 137/891 |
| 4,445,976 A | | 5/1984 | LaDelfa et al. | |
| 4,524,681 A | * | 6/1985 | Harris et al. | 99/474 |
| 4,569,850 A | * | 2/1986 | Harris et al. | 426/482 |
| 4,971,796 A | * | 11/1990 | Sjogren | 424/417 |
| 5,098,557 A | * | 3/1992 | Hirschler et al. | 209/29 |
| 5,236,132 A | * | 8/1993 | Rowley, Jr. | 241/5 |
| 5,308,590 A | * | 5/1994 | Kersey et al. | 422/170 |
| 5,312,598 A | * | 5/1994 | Kersey et al. | 422/170 |
| 5,332,562 A | * | 7/1994 | Kersey et al. | 423/210 |
| 5,429,059 A | * | 7/1995 | Wagoner et al. | 110/234 |
| 5,482,630 A | * | 1/1996 | Lee et al. | 210/605 |

(Continued)

FOREIGN PATENT DOCUMENTS

DE 3802228 A1 * 7/1989

(Continued)

OTHER PUBLICATIONS

Search Report—EPO, Aug. 2, 2008.

(Continued)

*Primary Examiner* — Steve Gravini
(74) *Attorney, Agent, or Firm* — Robert C. Klinger

(57) ABSTRACT

A method and apparatus for drying and reducing the particle size of malleable material. Preferred embodiments of the invention include a drying apparatus for use with a malleable material, comprising a blower, an airlock feeder, a main line which contains an accelerator, a conditioning chamber, and a dehydration chamber, a polishing line which contains an accelerator, a conditioning chamber, and a dehydration chamber, and a squid line blower for providing pressurized heated air to the apparatus. An alternative preferred embodiment of the invention comprises a method of drying and size reducing malleable material.

14 Claims, 1 Drawing Sheet

U.S. PATENT DOCUMENTS 5,556,536 A * 9/1996 Turk ..... 210/150
5,598,979 A * 2/1997 Rowley, Jr. ..... 241/5
5,630,368 A * 5/1997 Wagoner et al. ..... 110/234
5,637,152 A * 6/1997 Robinson et al. ..... 134/12
5,655,853 A * 8/1997 Wormser ..... 406/66
5,683,041 A * 11/1997 Sewill et al. ..... 241/19
5,685,335 A * 11/1997 Sewill et al. ..... 137/527.6
5,727,740 A * 3/1998 Robinson et al. ..... 241/20
5,732,654 A * 3/1998 Perez et al. ..... 119/204
5,902,224 A * 5/1999 Bloom ..... 494/25
5,947,057 A * 9/1999 Perez et al. ..... 119/211
5,961,831 A * 10/1999 Lee et al. ..... 210/614
5,980,962 A * 11/1999 Bracken et al. ..... 426/241
5,997,220 A * 12/1999 Wormser ..... 406/66
6,010,729 A * 1/2000 Gutzmann et al. ..... 426/321
6,103,286 A * 8/2000 Gutzmann et al. ..... 426/332
6,113,963 A * 9/2000 Gutzmann et al. ..... 426/321
6,171,480 B1 * 1/2001 Lee et al. ..... 210/85
6,183,807 B1 * 2/2001 Gutzmann et al. ..... 426/652
6,250,236 B1 * 6/2001 Feizollahi ..... 110/346
6,256,902 B1 * 7/2001 Flaherty et al. ..... 34/379
6,383,251 B1 * 5/2002 Sherwood ..... 75/384
6,491,242 B1 12/2002 Dingee, IV et al.
6,503,831 B2 * 1/2003 Speakman ..... 438/674
6,517,015 B2 * 2/2003 Rowley, Jr. ..... 241/5
6,545,047 B2 * 4/2003 Gutzmann et al. ..... 514/557
6,566,380 B2 * 5/2003 Reed et al. ..... 514/357
6,569,662 B1 * 5/2003 Tang et al. ..... 435/212
6,652,802 B2 * 11/2003 Sherwood ..... 266/173
6,713,389 B2 * 3/2004 Speakman ..... 438/674
6,715,705 B2 * 4/2004 Rowley, Jr. ..... 241/5
7,040,557 B2 * 5/2006 Graham et al. ..... 241/1
7,059,550 B2 * 6/2006 Graham et al. ..... 241/1
7,129,166 B2 * 10/2006 Speakman ..... 438/674
7,131,389 B1 * 11/2006 Hawkes ..... 114/330
7,137,580 B2 * 11/2006 Graham et al. ..... 241/1
7,323,634 B2 * 1/2008 Speakman ..... 136/256
7,374,113 B2 * 5/2008 Graham et al. ..... 241/1
7,399,405 B2 * 7/2008 Matsuura ..... 208/308
7,429,008 B2 * 9/2008 Graham et al. ..... 241/1
7,445,806 B2 * 11/2008 Shah et al. ..... 426/479
7,473,551 B2 * 1/2009 Warthoe ..... 435/287.2
7,500,830 B2 * 3/2009 Graham et al. ..... 416/186 R
7,504,124 B2 * 3/2009 Man et al. ..... 426/332
7,507,429 B2 * 3/2009 Man et al. ..... 426/332
7,607,338 B1 * 10/2009 Lewis et al. ..... 73/31.02
7,618,883 B2 * 11/2009 Sasaki et al. ..... 438/528
7,638,070 B2 * 12/2009 Johnson et al. ..... 252/373
7,696,072 B2 * 4/2010 Sasaki et al. ..... 438/513
7,709,362 B2 * 5/2010 Sasaki et al. ..... 438/513
7,741,199 B2 * 6/2010 Sasaki et al. ..... 438/513
7,803,351 B2 * 9/2010 Sharma et al. ..... 424/1.69
7,811,981 B2 * 10/2010 Roiz et al. ..... 424/94.61
7,858,336 B1 * 12/2010 Garner et al. ..... 435/41
7,888,062 B1 * 2/2011 Garner et al. ..... 435/41
2002/0000485 A1 * 1/2002 Rowley, Jr. ..... 241/39
2002/0105080 A1 * 8/2002 Speakman ..... 257/749
2002/0107373 A1 * 8/2002 Curtis et al. ..... 536/23.1
2002/0130448 A1 * 9/2002 Sherwood ..... 266/173
2002/0173545 A1 * 11/2002 Gutzmann et al. ..... 514/557
2003/0076649 A1 * 4/2003 Speakman ..... 361/524
2003/0080224 A1 * 5/2003 Rowley, Jr. ..... 241/5
2003/0104529 A1 * 6/2003 Zhou et al. ..... 435/69.1
2003/0199583 A1 * 10/2003 Gutzmann et al. ..... 514/558
2003/0216337 A1 * 11/2003 Hallahan ..... 514/44
2003/0219744 A1 * 11/2003 Tang et al. ..... 435/6
2004/0056779 A1 * 3/2004 Rast ..... 340/985
2004/0151014 A1 * 8/2004 Speakman ..... 365/49
2004/0200910 A1 10/2004 Graham et al.
2004/0210289 A1 * 10/2004 Wang et al. ..... 607/116
2004/0254419 A1 * 12/2004 Wang et al. ..... 600/8
2005/0025797 A1 * 2/2005 Wang et al. ..... 424/422
2005/0044911 A1 * 3/2005 Shimose ..... 71/8
2005/0079132 A1 * 4/2005 Wang et al. ..... 424/1.11
2005/0107870 A1 * 5/2005 Wang et al. ..... 623/1.44
2005/0113327 A1 * 5/2005 Roiz et al. ..... 514/44
2005/0147692 A1 * 7/2005 Roth ..... 424/600
2005/0153031 A1 * 7/2005 Man et al. ..... 426/332
2005/0163897 A1 * 7/2005 Man et al. ..... 426/332
2005/0170019 A1 * 8/2005 Roth ..... 424/705
2005/0215764 A1 * 9/2005 Tuszynski et al. ..... 530/358
2005/0239060 A1 * 10/2005 Tang et al. ..... 435/6
2005/0249667 A1 * 11/2005 Tuszynski et al. ..... 424/9.3
2006/0027487 A1 * 2/2006 Matsuura ..... 208/308
2006/0039859 A1 * 2/2006 Sharma et al. ..... 424/1.49
2006/0041448 A1 * 2/2006 Patterson et al. ..... 705/1
2006/0045951 A1 * 3/2006 Shah et al. ..... 426/518
2006/0246438 A1 * 11/2006 McCall et al. ..... 435/6
2007/0010702 A1 * 1/2007 Wang et al. ..... 600/8
2007/0042094 A1 * 2/2007 Warf et al. ..... 426/332
2007/0087564 A1 * 4/2007 Speakman ..... 438/674
2007/0292580 A1 * 12/2007 Gutzmann et al. ..... 426/532
2008/0028633 A1 * 2/2008 Dingee ..... 34/446
2008/0131419 A1 * 6/2008 Roiz et al. ..... 424/94.6
2008/0180259 A1 * 7/2008 Jung et al. ..... 340/627
2008/0181816 A1 * 7/2008 Jung et al. ..... 422/50
2008/0181820 A1 * 7/2008 Jung et al. ..... 422/68.1
2008/0181821 A1 * 7/2008 Jung et al. ..... 42/82.02
2008/0182339 A1 * 7/2008 Jung et al. ..... 436/174
2009/0062581 A1 * 3/2009 Appel et al. ..... 585/241
2009/0081129 A1 * 3/2009 Neff et al. ..... 424/9.6
2009/0119990 A1 * 5/2009 Johnson et al. ..... 48/61
2009/0119991 A1 * 5/2009 Johnson et al. ..... 48/78
2009/0119992 A1 * 5/2009 Johnson et al. ..... 48/89
2009/0119994 A1 * 5/2009 Johnson et al. ..... 48/62 R
2009/0126270 A1 * 5/2009 Johnson et al. ..... 48/61
2009/0126276 A1 * 5/2009 Johnson et al. ..... 48/62 R
2009/0136638 A1 * 5/2009 Fujie et al. ..... 426/314
2009/0143481 A1 * 6/2009 Man et al. ..... 514/714
2009/0189617 A1 * 7/2009 Burns et al. ..... 324/649
2009/0194269 A1 * 8/2009 Vinegar ..... 166/60
2009/0194282 A1 * 8/2009 Beer et al. ..... 166/272.7
2009/0194286 A1 * 8/2009 Mason ..... 166/302
2009/0194287 A1 * 8/2009 Nguyen et al. ..... 166/302
2009/0194329 A1 * 8/2009 Guimerans et al. ..... 175/17
2009/0194333 A1 * 8/2009 MacDonald ..... 175/45
2009/0194524 A1 * 8/2009 Kim ..... 219/544
2009/0200022 A1 * 8/2009 Bravo et al. ..... 166/256
2009/0200023 A1 * 8/2009 Costello et al. ..... 166/260
2009/0200025 A1 * 8/2009 Bravo ..... 166/265
2009/0200031 A1 * 8/2009 Miller et al. ..... 166/302
2009/0200290 A1 * 8/2009 Cardinal et al. ..... 219/488
2009/0200854 A1 * 8/2009 Vinegar ..... 299/5
2009/0260823 A1 * 10/2009 Prince-Wright et al. ..... 166/302
2009/0260824 A1 * 10/2009 Burns et al. ..... 166/302
2009/0272526 A1 * 11/2009 Burns et al. ..... 166/248
2009/0272533 A1 * 11/2009 Burns et al. ..... 166/272.7
2009/0272535 A1 * 11/2009 Burns et al. ..... 166/302
2009/0272536 A1 * 11/2009 Burns et al. ..... 166/302
2009/0272578 A1 * 11/2009 MacDonald ..... 175/26
2009/0294908 A1 * 12/2009 Yang et al. ..... 257/615
2010/0210745 A1 * 8/2010 McDaniel et al. ..... 521/55
2010/0223804 A1 * 9/2010 Flaherty et al. ..... 34/279
2010/0227004 A1 * 9/2010 Warf et al. ..... 424/665
2010/0233146 A1 * 9/2010 McDaniel ..... 424/94.2
2011/0008314 A1 * 1/2011 Roiz et al. ..... 424/94.6

FOREIGN PATENT DOCUMENTS

EP 1 136 129 A1 9/2001
JP 55081544 A * 6/1980
JP 59106317 A * 6/1984
JP 60002836 A * 1/1985
JP 04126912 A * 4/1992
JP 05099193 A * 4/1993
JP 05202897 A * 8/1993
JP 05248698 A * 9/1993
JP 06288389 A * 10/1994
JP 08196202 A * 8/1996
JP 08196943 A * 8/1996
WO WO 2008016623 A2 * 2/2008

OTHER PUBLICATIONS

Written Opinion—EPO, Aug. 2, 2008.

* cited by examiner

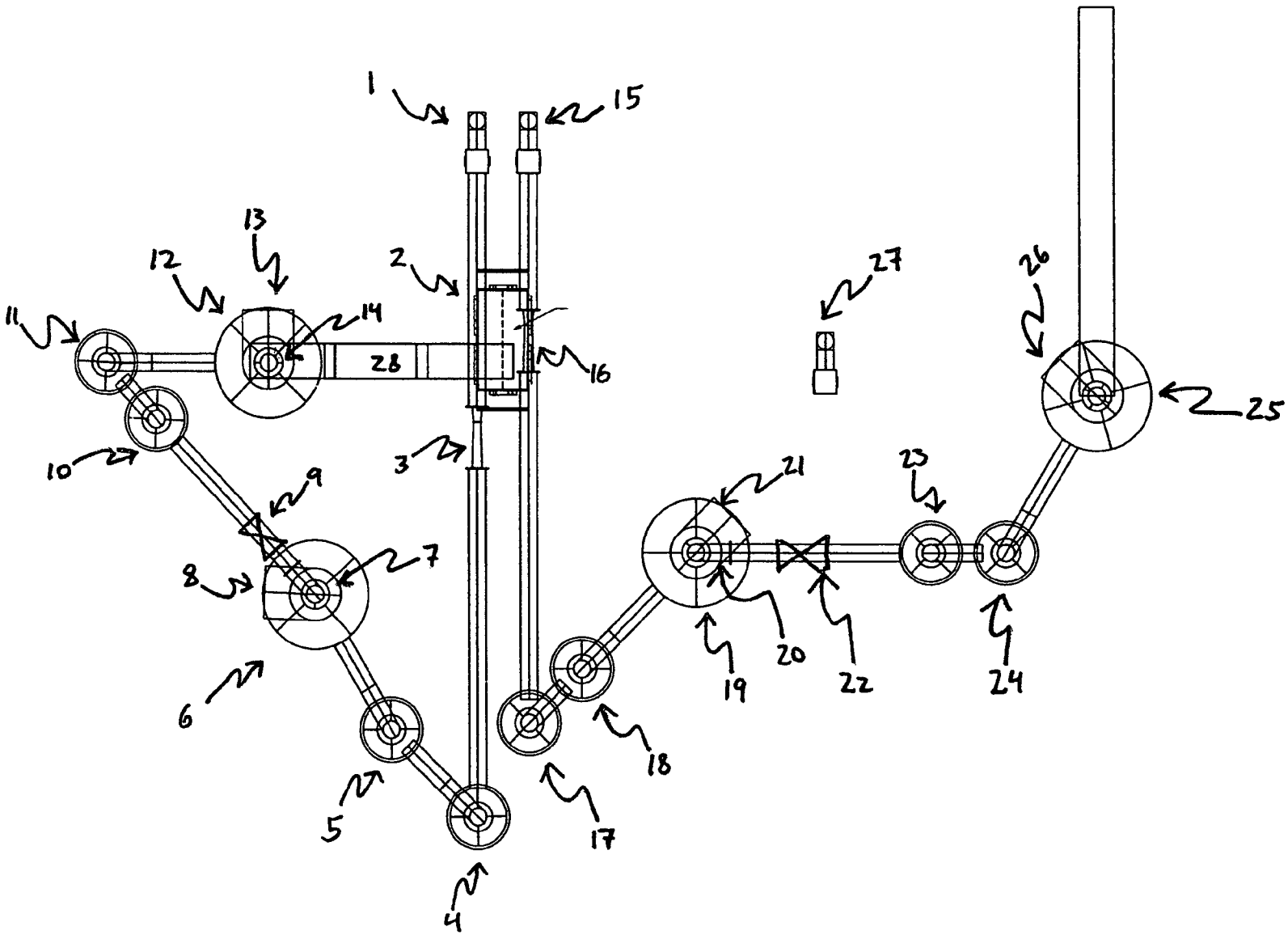
1
2
3
4
5
6
7
8
9
10
11
12
13
14
15
16
17
18
19
20
21
22
23
24
25
26
27
28

DRYING SYSTEM

CLAIM OF PRIORITY

This application claims priority of U.S. Provisional Ser. No. 60/834,595, entitled "IMPROVED DRYING SYSTEM" filed Aug. 1, 2006, incorporated herein by reference.

FIELD OF THE INVENTION

The present invention relates to a method and apparatus for drying and reducing the particle size of malleable material. Preferred embodiments of the invention include a drying apparatus for use with a malleable materials and a method of drying and size reducing malleable material.

BACKGROUND OF THE INVENTION

There is a need in many industries to economically recover valuable products from what are considered to be wastes having a high moisture content and a non-uniform particle size. It is desirable to recover valuable products with greatly reduced moisture content, substantially uniform size, and without significant loss of beneficial attributes of the material. These industries include the agricultural, food processing, mining, coal, pulp and paper, and oil and gas industries. As one example, in livestock feed lots raw manure is produced in large volumes, and the most common revitalization mechanism is to apply it to land in the same water shed. However, such operations have become an environmental concern for a number of reasons, and in view of the large volume of manure produced (e.g. estimated to be about 1.4 billion tons of manure in the U.S.A. Alone in 1998), stockpiles of manure and other waste products are becoming a significant cause for concern.

While presently a cause for concern, raw manure, when properly processed, has many applications. It can be used as a fertilizer, a soil amendment for such areas as parks, golf courses, and lawns, and in a number of other situations. In known systems, raw manure is typically mechanically milled or ground with hammer mills or grinders prior to processes in which the manure is dried in a rotary drum drier at between 350-500° F. using an external heat source. A roll compact or is then used to form brunettes from the pulverized and dried raw manure, which are then re-ground to a desired granule size. Such systems have a number of environmental and economic drawbacks that make them largely, or wholly, not cost effective.

Not only is conventional processing marginally or not cost effective, it also significantly reduces the quality of the processed product. The heat used for drying not only is produced expensively and with environmental adverse consequences, but it destroys a significant amount of the organic material in the manure. Also, the forming process produces a greater volume of airborne products that can present a health and safety hazard, requiring the utilization of air pollution controls.

SUMMARY OF INVENTION

The present invention achieves technical advantages as an apparatus for drying and reducing particle size of a malleable material by including a polishing line which includes an accelerator. Apparatus may further include a conditioning chamber, a dehydration chamber, and a squid line blower for providing pressurized heated air to the apparatus. An alternative preferred embodiment of the invention comprises a method of drying and size reducing malleable material.

BRIEF DESCRIPTION OF THE DRAWINGS

FIG. 1 is a schematic view of exemplary apparatus according to the present invention for practicing the exemplary method according to the present invention.

DETAILED DESCRIPTION OF THE PRESENT INVENTION

According to the present invention, a method and apparatus are provided that overcome the drawbacks associated with the reduction of a large variety of different types of malleable material (such as manure, municipal sludge, coal and coal fines, food wastes, pulp and paper wastes, mine tailings, and dredge spoils). The method and system according to the present invention avoid almost all of the problems associated with the prior art systems and methods. According to the present invention one can produce a product having a much lower moisture content (typically a quarter or less of the original moisture content) while significantly reducing the average particle size (e.g. by at least 20%), and making the particle size substantially more uniform. The method of the invention can be practiced without any, or much less, external heat.

In a preferred embodiment, a blower may be a device for generating airflow, and may generate a high velocity air flow, e.g. air at a velocity of about 100-200 mph. An example (only) of a blower suitable for the purposes of the present invention is the Roots Blower, Model 14 AZRA5, manufactured by the Roots Dresser Company of Connersville, Ind.

In a preferred embodiment, an airlock feeder may be capable of feeding material into the high speed airflow provided by the blower so that the material is entrained in the airflow. An example of an airlock feeder could comprise a conveyor having an inlet and an outlet vertically above the inlet for conveying the material (such as manure) into the open top of a hopper. The material falls out of the bottom of the hopper (e.g. a live bottom hopper) into operative association with a pair of screw conveyors which convey the material to a star feeder, having a star wheel that makes substantially sealing engagement with the surrounding housing. The star wheel is driven by a conventional motor, and when operating, feeds material into the high speed air flow within a conduit so that the material is entrained in an air flow.

In a preferred embodiment, an accelerator (also called a jet mill) is capable of increasing the speed of the air flow with entrained particles to super-cyclonic speed, such that at least some of the particles are moving at super-cyclonic speed, that is about 400-500 mph. In the preferred form, the accelerator establishes a substantially bullet profile of air flow with entrained material. The air flow profile has a substantially zero velocity at the periphery thereof, immediately adjacent the interior of the housing, and a velocity of over about 400 mph at the center of the air flow, that is the center of the housing of a second end of a central conduit. Midway between the housing wall and the center of the housing the air flow speed of profile may be approximately 250 mph.

The accelerator preferably further comprises a substantially annular chamber surrounding the second end of a central conduit within a housing, and a connection from the blower in the annular chamber between the first and second ends of the central conduit. In a preferred embodiment, the connection downstream-most portion is spaced a distance from the second end of the central conduit in the dimension of elongation of the housing.

In a preferred embodiment, a conditioning chamber may be a device capable of reducing particle size and drying particles. In a preferred form, super-cyclonic speed air with entrained particles passes through a conduit to at least one particle size reducer and drier. Preferably two (or more) in-series conditioning chambers are provided as a size reducer and drier, a top outlet from the first chamber or vessel being connected to the inlet for the second chamber or vessel, and the top outlet from the second chamber or vessel being connected to the inlet of the particle separator. The inlet to the first vessel is tangential, and each of the vessels is generally cyclone-shaped. The second vessel inlet is vertically above the outlet from the first vessel, e.g. about 1-4 feet, and the first conduit connecting them is generally curved and preferably has a radius of about 28 feet.

In a preferred embodiment of a dehydration cone, the inlet is also vertically above the outlet from the second vessel, e.g. about 3-6 feet, and the second conduit interconnecting the outlet and the inlet is also generally curved. In a preferred embodiment, all of the inlets are tangential, imparting a whirling action to the air with entrained particles introduced into each of the vessels and the separator. The second conduit preferably has a larger diameter (e.g. by at least 10%) than the first conduit.

In a preferred embodiment, each of the generally cyclone-shaped vessels has directional breaker bars mounted therein which create small turbulent areas so that new incoming solids entrained in the air have particle-to-particle collisions with solids already in the chamber, for example at an impact angle of about 60°. This results in particle size reduction (and moisture release), and ultimately the smaller size particles pass through the open bottom of the central tube or sleeve in each of the chambers to pass to the respective outlet conduit.

The longer the particles are within a chamber, the more particle-to-particle collisions that there are, and the greater the size reduction will be. The retention time within the chambers can be adjusted by utilizing valved auxiliary air inlets adjacent the bottom of each of the vessels, and/or by adjusting the effective length of sleeves.

A dehydration cone is capable of separating moist air from particles, which are discharged from the bottom of the dehydration cone. The separator or dehydration cone may comprise a cyclonic separator, in which air with entrained particles swirls within the separator, after being tangentially introduced by inlet, with the particles being discharged from the bottom, and with the moisture laden air which entrain the particles being discharged through an outlet.

In a preferred embodiment, the invention may comprise an apparatus including both a main line and a polishing line. In this embodiment, a main line may include an accelerator, a conditioning chamber, and a dehydration cone. The polishing line may include a second accelerator, a second conditioning chamber, and a second dehydration chamber. The main line may be operatively connected to the polishing line such that the malleable material moves first through the main line, and subsequently through the polishing line.

A preferred embodiment of the invention may further comprise a squid line blower, which is operatively connected to the apparatus at several points in order to provide pressurized air to the apparatus.

The invention specifically comprises all narrower ranges within a broad range. For example, reducing the moisture content by at least 20% means by 30-50%, 50-99%, 60-80%, and all other narrower ranges within the broad range.

In a preferred embodiment, the present invention may not include an external heat source, and no heat is added except by the generation of air at a high pressure. The currently claimed invention is capable of processing raw malleable material which may have a moisture content of between 50% and 75%, preferably between 55% and 70%, and most preferably about 70% to form material which has a moisture content of between 5% and 15%, most commonly around 10%. The particle size of processed material can be as low as 200 mesh. In addition, the current invention is capable of creating a uniform particle size, and it is common to observe that around 55% of material which has undergone one round of processing conforms to the desired mesh size. Further, the invention is capable of producing a product in which organics or pathogens were undetectable using conventional laboratory techniques in cases where the moisture content of the material had been reduced to <10%.

Materials appropriate for use with the currently claimed apparatus and method include, but are not limited to, crustaceans, paper mill sludge, animal waste or sludge, manure, human waste or sludge, wet distillery grain, bark, compost, thatch, algae, kelp, food waste, and other forms of malleable materials as well as municipal sludge, coal and coal fines, wood waste, pulp and paper mill waste, mine tailings, dredge spoils, or combinations thereof.

The method associated with the currently claimed invention has been observed by an independent laboratory to generate only 33% of the emissions which are allowable under EPA guidelines, making this process environmentally desirable.

FIG. 1 illustrates an exemplary apparatus system according to the present invention for drying and reducing the particle size of a material, such as manure, municipal sludge, coal and coal fines, wood waste, pulp and paper mill waste, mine tailings, dredge spoils, or combinations thereof. While the invention will be described primarily with respect to treatment of manure, it is to be understood that these other materials, or a wide variety of other materials which desirably need to have the moisture content thereof reduced, as well as the average particle size thereof reduced and the uniformity of the particle size enhanced, may be treated.

The exemplary apparatus according to the present invention is illustrated generally by reference to FIG. 1. It comprises as major components thereof one or more blowers (1, 15), one or more squid line blowers (27), one or more air lock feeders (2), one or more single valve supplemental air accelerators (SAA), one or more conditioning chambers (4, 5, 10, 11, 17, 18, 23, 24), and one or more D-hydration cones (6, 12, 19, 25).

A preferred embodiment of an apparatus according to the present invention may comprise a Main Line and a Polishing Line such that material entering the apparatus is first processed through the Main Line and subsequently processed through the Polishing Line. Each of the Main Line and the Polishing Line may comprise one or more blowers (1, 15), one or more squid line blowers (27), one or more air lock feeders (2), one or more single valve supplemental air accelerators (SAA), one or more conditioning chambers (4, 5, 10, 11, 17, 18, 23, 24), and one or more D-hydration cones (6, 12, 19, 25).

In a preferred embodiment of the invention, a 'Main Line' Mach1 air lock Feeder (2) is operatively connected to receive air from a main line blower (1) located perpendicular to the infeed of material with the rotary paddles extended into and parallel to the air stream.

The embodiment further comprises a first 'Main Line' single valve supplemental air accelerator (SAA) venturi (3)

supplied with dedicated heat and pressurized air from a squid line blower (27) to increase the shearing process and velocity collision in a first and a second conditioning chamber (4 and 5, respectively).

The first SAA venturi (3) is in fluid communication with the first and a second conditioning chamber (4 and 5, respectively) designed to uniformly blend the material as it sets up the particle entrance to a first D-hydration cone (6). The first and second conditioning chambers (4 and 5, respectively) are each equipped with two valved side air accelerator injector ports supplying dedicated heated and pressurized air from the separate squid line blower (27). Both conditioning chambers (4 and 5) are equipped with adjustable pressure sleeves inside the cone to facilitate retention time.

The second conditioning chamber is in fluid communication with the first D-hydration cone (6), and material entering into this size cone de-accelerates to allow for vaporized moisture to separate from the material and discharge to a first exhaust duct (8) connected to the D-hydration cone (6) as the material continues on a downward path to a first venturi elbow (7). The first exhaust duct (8) outlet is equipped with a manual adjustable damper control to regulate discharge pressure and exhaust should be collected at this point to transfer that moisture to a remote location.

The valved first venturi elbow (7) is connected to a next in line valved second SAA venturi (9) re-accelerating the material once more, and both are supplied with dedicated heat and pressurized air from the squid line blower (27) as the material enters a third conditioning chamber (10) which is in fluid communication with a fourth conditioning chamber (11), each equipped with two valved side air accelerator injector ports, supplying dedicated heated and pressurized air from the squid line blower (27). The conditioning chambers are also equipped with an adjustable pressure sleeve for retention time.

The fourth conditioning chamber (11) is in fluid communication with a second D-hydration cone (12), which also separates the moisture from the particulates. The moisture will exit through a second top exhaust duct outlet (13) connected to the second D-hydration cone (12) while the material continues downward through a second venturi elbow (14) to the discharge airlock/auger (28). The discharge moisture should be collected by the same duct as the moisture from the first exhaust duct (8) outlet connected to the first D-hydration chamber (6) in parallel.

At this point in the process the moisture in the material has been separated and reduced significantly, with the particulates continuing on to the discharge auger (28) and subsequently being transferred back up to the Mach1 air lock feeder (2) to enter the 'Polishing Line' second stage. Once inside the Mach1 air lock feeder (2) cell the material re-enters a second air lock feeder operatively connected to receive air from a second blower (15) and enters the new air stream with a third single valve SAA venturi (16) to increase shearing and dewatering the material as it enters this final drying stage.

The third SAA venturi (16) is in fluid communication with a fifth and a sixth conditioning chamber (17 and 18, respectively) to receive the material. Chamber cones are each equipped with two valved side air accelerator injector ports supplying dedicated heat and pressurized air from the squid line blower (27) to further separate the moisture laden material and prepare it for a third D-hydration Cone (19).

The third D-hydration Cone (19) receives the material; this cone is equipped with one valved side air accelerator port located at the collared entrance to the cone supplying dedicated heat and pressurized air from the squid line blower (27), enhancing the drying process. The material continues downward thru a venturi elbow (20) as the moisture exits through the top discharge exhaust duct (21) and is collected and removed remotely in parallel with the previously mentioned exhaust ducts.

Next the particulates are re-accelerated from the third venturi elbow (20) thru a fourth single valve supplementary air accelerator (SAA) venturi (22) which is in fluid communication with a seventh and an eighth conditioning chamber (23 and 24, respectively), each of which is supplied with dedicated heat and pressurized air from the squid line blower (27).

The seventh and the eighth conditioning chambers (23 and 24, respectively) are each equipped with two valved side air accelerator injector ports supplying dedicated heat and pressurized air from the squid line blower (27) producing regulated heated chambers to deliver the material to a fourth D-hydration Cone (25).

This final D-hydration Cone (25) comes equipped with a valved side air accelerator injector port supplying dedicated heat and pressurized air from the squid line blower (27) to facilitate the actual moisture allowed in material throughput. The accepted moisture/material content is released downward thru a discharge airlock, while the remaining moisture is discharged to the top of this cone via a fourth exhaust duct (26) to be collected remotely in parallel with the discharge from the previously mentioned exhaust ducts.

The "squid line blower" (27) delivers dedicated air to a 'Transducer Heat Manifold' designed to deliver pressurized heated air to a multi port manifold for distribution to all the venturi apparatus and the side air accelerator ports located on the various conditioning chambers and the D-hydration Cones.

Although preferred embodiments of the present invention are illustrated in the accompanied drawings and described in the foregoing detailed description, it will be understood that the invention is not limited to the embodiments disclosed but is capable of numerous rearrangements, modifications and substitutions in parts and elements without departing from the spirit of the invention. For example, any number of fastening mechanisms on the tabs of the liner can be used to accomplish the objectives of restraining the liner to the waste container, and thereafter can be used to secure the liner for disposal. Further, any number of motifs, such as cartoon characters or appealing designs, in the liner can be used to serve to motivate use of the trainer by the toddler and serve as an indicia that the liner needs to be replaced.

Though the invention has been described herein with respect to a specific preferred embodiment, many variations and modifications will become apparent to those skilled in the art upon reading the present application. It is therefore the intention that the appended claims be interpreted as broadly as possible in view of the prior art to include all such variations and modifications.

What is claimed is:

1. A drying apparatus configured to dry a malleable material comprising:

a) a blower configured to generate air;

b) an airlock feeder configured to receive the air from said blower;

c) a main line configured to receive the air from the airlock feeder, wherein the main line comprises an accelerator, a conditioning chamber, and a dehydration cone having a main outlet; and d) a first squid line blower configured to provide pressured air to the main line, wherein the dehydration cone comprises an exhaust duct having an adjustable damper configured to regulate discharge pressure and exhausted air at the dehydration cone main outlet.

2. The drying apparatus of claim 1, wherein the airlock feeder is adapted to feed the malleable material into the air provided by the blower so that the material is entrained in the air.

3. The drying apparatus of claim 2, wherein the accelerator is adapted to increase a speed of the air with the entrained material to cyclonic speed.

4. The drying apparatus of claim 1 wherein the exhaust duct is configured to regulate the moisture of the air discharged from the hydration cone main outlet.

5. The drying apparatus of claim 4 wherein the exhaust duct is configured to exhaust a portion of the moist air from the dehydration cone.

6. The drying apparatus of claim 1 wherein the squid line is configured to provide the pressurized air to the dehydration cone.

7. The drying apparatus of claim 2 wherein the exhaust duct is configured to exhaust a portion of the moist air from the dehydration cone.

8. The drying apparatus of claim 2 wherein the squid line is configured to provide the pressurized air to the dehydration cone.

9. The drying apparatus of claim 2, wherein the conditioning chamber is configured to reduce a particle size of the entrained material.

10. The drying apparatus of claim 2, wherein the dehydration cone is configured to separate moist air from the entrained material.

11. The drying apparatus of claim 2 wherein the exhaust duct is configured at an upper portion of the dehydration cone.

12. The drying apparatus of claim 11 wherein material is configured to be discharged from a bottom of the dehydration cone.

13. The drying apparatus of claim 1 comprising a second dehydration cone configured to receive the regulated discharged air from the first hydration cone main outlet.

14. The drying apparatus of claim 13 comprising a second squid line blower configured to provide pressured air to the second dehydration cone, wherein the second dehydration cone comprises an exhaust duct having an adjustable damper configured to regulate discharge pressure and exhausted air from the second dehydration cone.

* * * * *